US012674471B2

(12) United States Patent
Chen et al.

(10) Patent No.: US 12,674,471 B2
(45) Date of Patent: Jul. 7, 2026

(54) FAN HOUSING STRUCTURE

(71) Applicant: Delta Electronics, Inc., Taoyuan City (TW)

(72) Inventors: Wen-Shiang Chen, Taoyuan City (TW); Hui-Lun Chin, Taoyuan City (TW); Chao-Wen Lu, Taoyuan City (TW); Shu-Cheng Yang, Taoyuan City (TW); Ting-Yuan Wu, Taoyuan City (TW); Pai-Yu Hsiao, Taoyuan City (TW)

(73) Assignee: Delta Electronics, Inc., Taoyuan City (TW)

( * ) Notice: Subject to any disclaimer, the term of this patent is extended or adjusted under 35 U.S.C. 154(b) by 0 days.

(21) Appl. No.: 18/999,841

(22) Filed: Dec. 23, 2024

(65) Prior Publication Data

US 2026/0063146 A1 Mar. 5, 2026

(30) Foreign Application Priority Data

Sep. 4, 2024 (CN) ..... 202422156611.7

(51) Int. Cl.
*F04D 29/58* (2006.01)
*F04D 17/16* (2006.01)
*F04D 29/42* (2006.01)

(52) U.S. Cl.
CPC ..... *F04D 29/582* (2013.01); *F04D 17/16* (2013.01); *F04D 29/4226* (2013.01)

(58) Field of Classification Search
CPC .... F04D 29/403; F04D 29/4226; F04D 29/58; F04D 29/584; F05D 2260/221; F05D 2260/2214; F05D 2260/22141; F05D 2240/14; H05K 7/20136; H05K 7/20154; H05K 7/20172
See application file for complete search history.

(56) References Cited

U.S. PATENT DOCUMENTS

| | | | | |
|---|---|---|---|---|
| 7,885,073 | B2 * | 2/2011 | Peng | H01L 23/467 165/104.33 |
| 12,120,848 | B2 * | 10/2024 | Wang | H05K 7/20336 |
| 12,185,494 | B2 * | 12/2024 | Chen | H05K 7/20154 |
| 2017/0367219 | A1 * | 12/2017 | Hsieh | H05K 7/20172 |
| 2024/0032236 | A1 * | 1/2024 | Chen | H05K 7/20172 |

* cited by examiner

*Primary Examiner* — Brian P Wolcott
(74) *Attorney, Agent, or Firm* — MUNCY, GEISSLER, OLDS & LOWE, P.C.

(57) ABSTRACT

A fan housing structure is provided. The fan housing structure includes a cooling component. The cooling component has a first sidewall, a second sidewall, a first chamber, and a first extension portion. The second sidewall is disposed opposite from the first sidewall and is connected to the first sidewall. The first chamber is formed between the first sidewall and the second sidewall. The first extension portion is formed integrally with the first sidewall, extending from the first sidewall and protruding from the second sidewall. The first extension portion has a first central part. The first central part has a connecting point for connecting a fan.

12 Claims, 7 Drawing Sheets

100

FAN HOUSING STRUCTURE

CROSS REFERENCE TO RELATED APPLICATIONS

This Application claims priority of China Patent Application No. 2024221566117, filed on Sep. 4, 2024, the entirety of which is incorporated by reference herein.

BACKGROUND OF THE INVENTION

Field of the Invention

The present invention relates to a fan housing structure, and, in particular, it relates to a fan housing structure that includes a vapor chamber.

Description of the Related Art

Solid metal materials (such as stainless steel) are usually used as the bearing support structure for the fan in conventional fan housings. However, the thermal conductivity of these metal materials limits the heat dissipation performance of the fan. As product performance requirements become increasingly stringent, conventional fan designs are no longer able to meet the increasing requirements on heat dissipation.

Therefore, it has become an important issue to improve cooling efficiency without increasing the volume of the structure.

BRIEF SUMMARY OF THE INVENTION

According to some embodiments of the present disclosure, a fan housing structure is provided, including a cooling component. The cooling component has a first sidewall, a second sidewall, a first chamber, and a first extension portion. The second sidewall is disposed opposite from the first sidewall, and it is connected to the first sidewall. The first chamber is formed between the first sidewall and the second sidewall. The first extension portion is formed integrally with the first sidewall, extending from the first sidewall and protruding from the second sidewall. The first extension portion has a first central part. The first central part has a connecting point for connecting a fan.

In some embodiments, an edge of the first sidewall and an edge of the second sidewall are connected by welding.

In some embodiments, the cooling component further includes a second extension portion that extends from the second sidewall and corresponds to the first extension portion.

In some embodiments, the second extension portion has one other connecting point that corresponds to the connecting point of the first extension portion. The fan is connected to the connecting point and the other connecting point at the same time.

In some embodiments, the entire first extension portion and the entire second extension portion are connected by welding.

In some embodiments, the cooling component further includes a second chamber that is formed between the first extension portion and the second extension portion.

In some embodiments, the second chamber is in fluid communication with the first chamber.

In some embodiments, the second extension portion has a second central part. The other connecting point is located at the second central part.

In some embodiments, the first central part and the second central part are connected by welding.

In some embodiments, the second chamber surrounds the first central part and the second central part.

In some embodiments, the area covered by the fan is larger than the area of the entire cooling component when viewed along a rotational axis of the fan.

In some embodiments, the fan housing structure further includes a casing that is connected to the cooling component and covers the fan.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
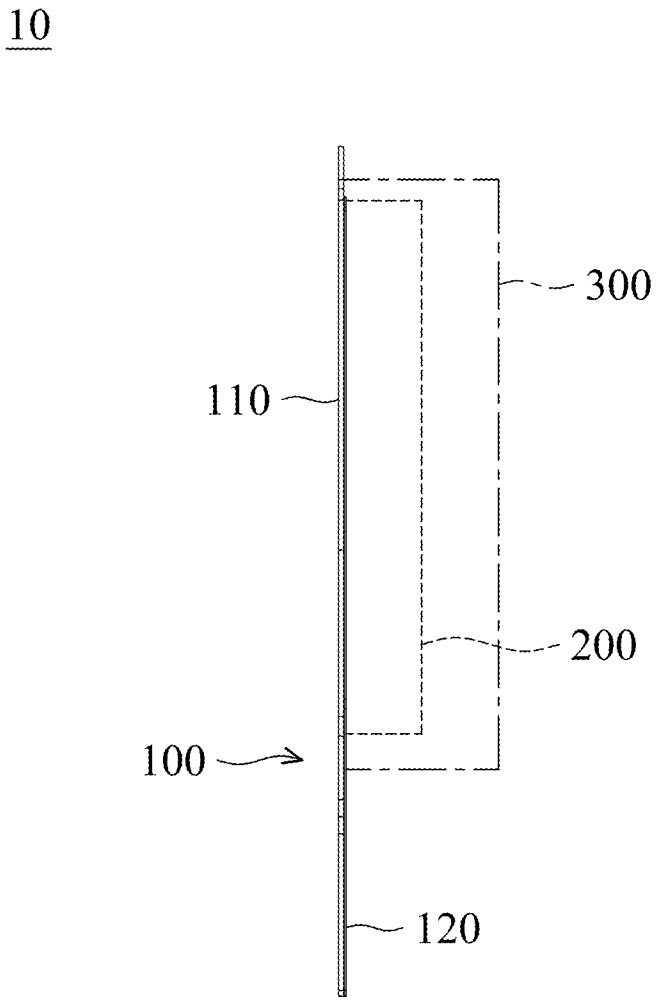
FIG. 1 shows a schematic side view of the fan housing structure, in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact and may also include embodiments in which additional features may be formed between the first and second features, such that the first and second features may not be in direct contact.

In addition, the present disclosure may repeat reference numerals and/or letters in the various embodiments. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "vertical," "above," "over," "below,", "bottom," etc. as well as derivatives thereof (e.g., "downwardly," "upwardly," etc.) are used for ease of the present disclosure of one feature relationship to another feature. The spatially relative terms are intended to cover different orientations of the device including the features.

Referring to FIG. 1, FIG. 1 shows a schematic side view of the fan housing structure 10, in accordance with some embodiments of the present disclosure. As shown in FIG. 1, the fan housing structure 10 mainly includes a cooling component 100. The fan 200 is connected and affixed to the cooling component 100 via, for example, rivets for bearings, or any suitable connecting components. In some embodiments, the fan housing structure 10 may further include a casing 300 that is connected to the cooling component 100 and covers the fan 200. The configurations, positions and sizes of the cooling component 100, the fan 200, and the casing 300 shown in FIG. 1 are not intended to be limiting. Users may change the relative positions and relative sizes of the cooling component 100, the fan 200, and the casing 300 according to actual needs.

Figure 2:
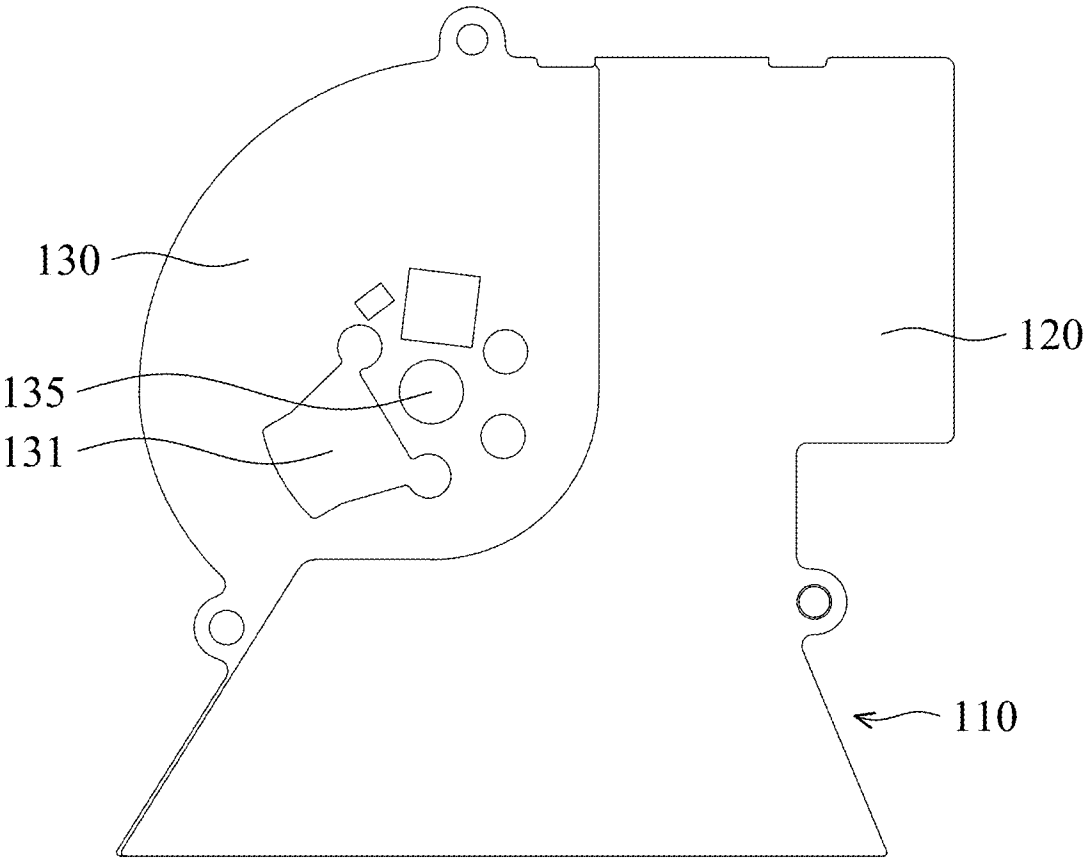
FIG. 2 shows a front view of the cooling component of the fan housing structure, in accordance with the first embodiment of the present disclosure.
Figure 3:
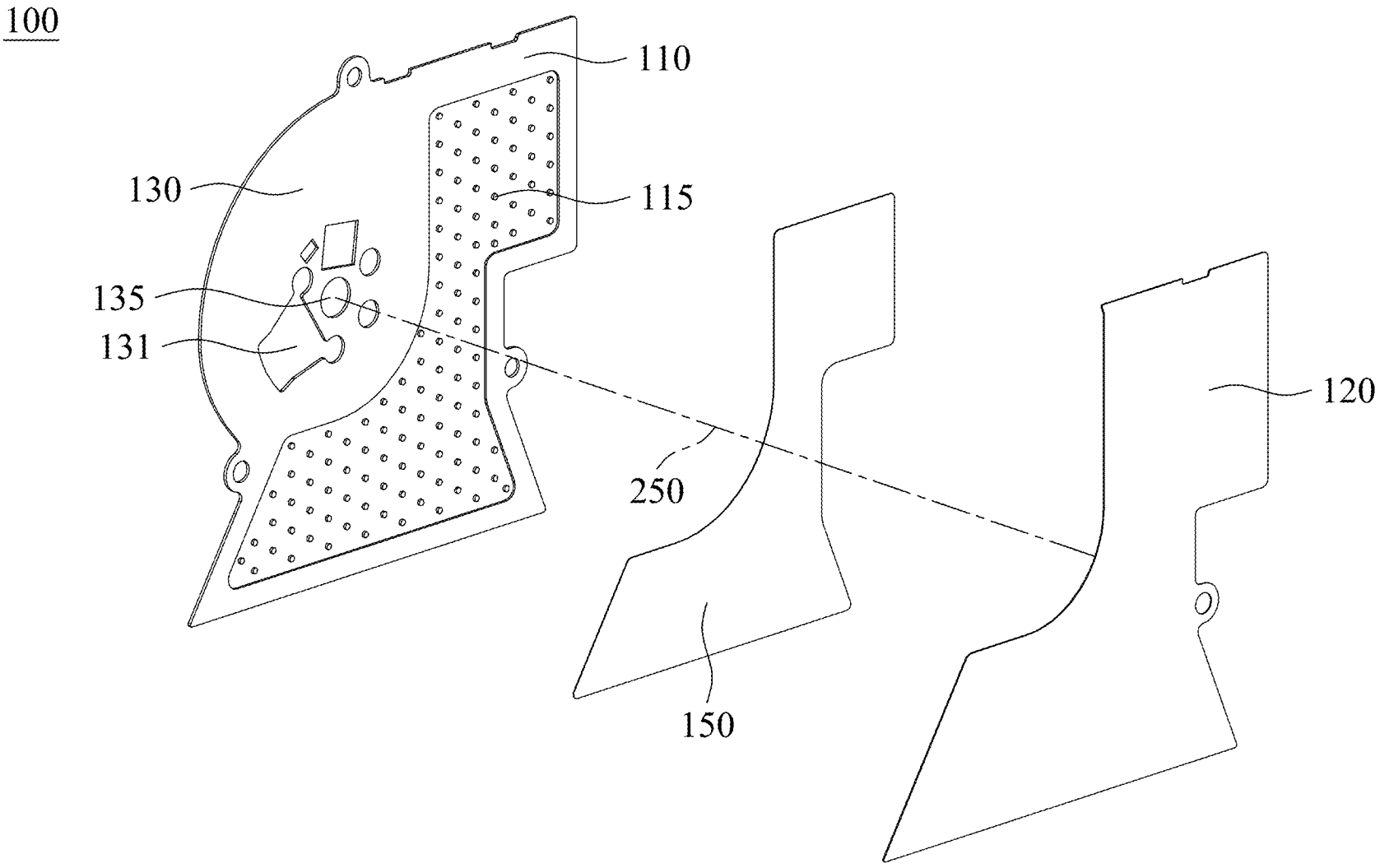
FIG. 3 shows a perspective exploded view of the cooling component of the fan housing structure, in accordance with the first embodiment of the present disclosure.

Next, the first embodiment of the present disclosure is described with respect to FIGS. 2 and 3. FIG. 2 shows a front view of the cooling component 100 of the fan housing structure 10, in accordance with the first embodiment of the present disclosure. FIG. 3 shows a perspective exploded view of the cooling component 100 of the fan housing structure 10, in accordance with the first embodiment of the present disclosure. As shown in FIGS. 2 and 3, the cooling component 100 mainly includes a first sidewall 110, a second sidewall 120, a first extension portion 130, and a first chamber 150.

In the embodiments according to the present disclosure, the cooling component 100 may be a vapor chamber that is formed by two sidewalls (i.e., the first sidewall 110 and the second sidewall 120). A chamber structure (i.e., the first chamber 150) is formed between these two sidewalls. In this chamber structure stores working fluid that is enclosed (not shown), which quickly diffuses the heat generated by local heat sources to a large surface area to improve heat dissipation efficiency. As such, compared with the conventional fan bearing support structure, by replacing the solid metal plate with a vapor chamber, the thermal conductivity can be greatly improved. The heat dissipation efficiency is further improved without increasing the structural volume.

In addition, in conventional vapor chambers, metals with lower hardness such as copper or copper alloy are usually used to form the sidewalls. In the embodiments according to the present disclosure, in addition to copper and copper alloys, metal materials with higher hardness (for example, Vickers hardness HV is above 100) such as stainless steel, aluminum, titanium, and titanium alloys can be used to form the sidewalls. It is beneficial to increase the supporting force and provide the fan 200 with more stable support.

In the first embodiment shown in FIGS. 2 and 3, the second sidewall 120 is disposed opposite from the first sidewall 110 and is connected to the first sidewall 110. The first sidewall 110 and the second sidewall 120 may have substantially the same shape. Thus, in the front view shown in FIG. 2, the first sidewall 110 is right behind the second sidewall 120 and therefore cannot be seen. In addition, the edge of the first sidewall 110 and the edge of the second sidewall 120 may be connected by welding.

A first chamber 150 is formed between the first sidewall 110 and the second sidewall 120 that are connected. In the embodiment shown in FIG. 3, a concaved portion 115 is formed on the first sidewall 110, and the first chamber 150 is disposed inside the concaved portion 115.

In the first embodiment, the first extension portion 130 and the first sidewall 110 are formed integrally, and the first extension portion 130 extends from the first sidewall 110. When the first sidewall 110 and the second sidewall 120 are bonded together, the first extension portion 130 protrudes from the second sidewall 120, as shown in FIG. 2.

As shown in FIGS. 2 and 3, the first extension portion 130 has a first central part 131. The first central part 131 has a connecting point 135 for connecting the fan 200.

In the present disclosure, the first central part 131 refers to a circular area with a specific diameter extending outward from the center of the connecting point 135. The specific diameter is not limited. Users may change this diameter according to actual needs.

In some embodiments, the fan 200 is connected at the connecting point 135. In other words, the connecting point 135 acts as the rivet point for the fan 200. The rotational axis 250 of the fan 200 passes through the connecting point 135, as shown in FIG. 3. In the embodiments shown in FIGS. 2 and 3, there are other openings of different shapes around the connecting point 135. These openings may be used to further secure the fan 200 or other components. However, the existence of these openings, their sizes and positions are not limited. Users may modify according to actual needs.

In addition, in the embodiment shown in FIG. 1, the fan 200 and the casing 300 are connected to the side where the second sidewall 120 is. However, users may connect the fan 200 and the casing 300 to the side of the first sidewall 110 that faces away from the second sidewall 120 according to actual needs.

In the embodiments of the present disclosure, a vapor chamber (i.e., the cooling component 100) is used as the bearing structure of the fan 200. As such, in addition to supporting the fan 200, the cooling component 100 can effectively enhance the cooling efficiency of the fan housing structure 10. In detail, the fan housing structure 10 according to the presently disclosed embodiments has a higher thermal conductivity compared to conventional fan housing structures. The cooling component 100 of the fan housing structure 10 can be directly assembled to a heat-producing element to minimize welding during the manufacturing process. This may reduce contact thermal resistance, thereby effectively enhancing the heat dissipation efficiency. Combining the fan 200 directly with the cooling component 100 to form an active heat dissipation module also helps to reduce the overall manufacturing cost. Without the need for other housings, it also helps to thin the overall structure and reduces the height.

Figure 4:
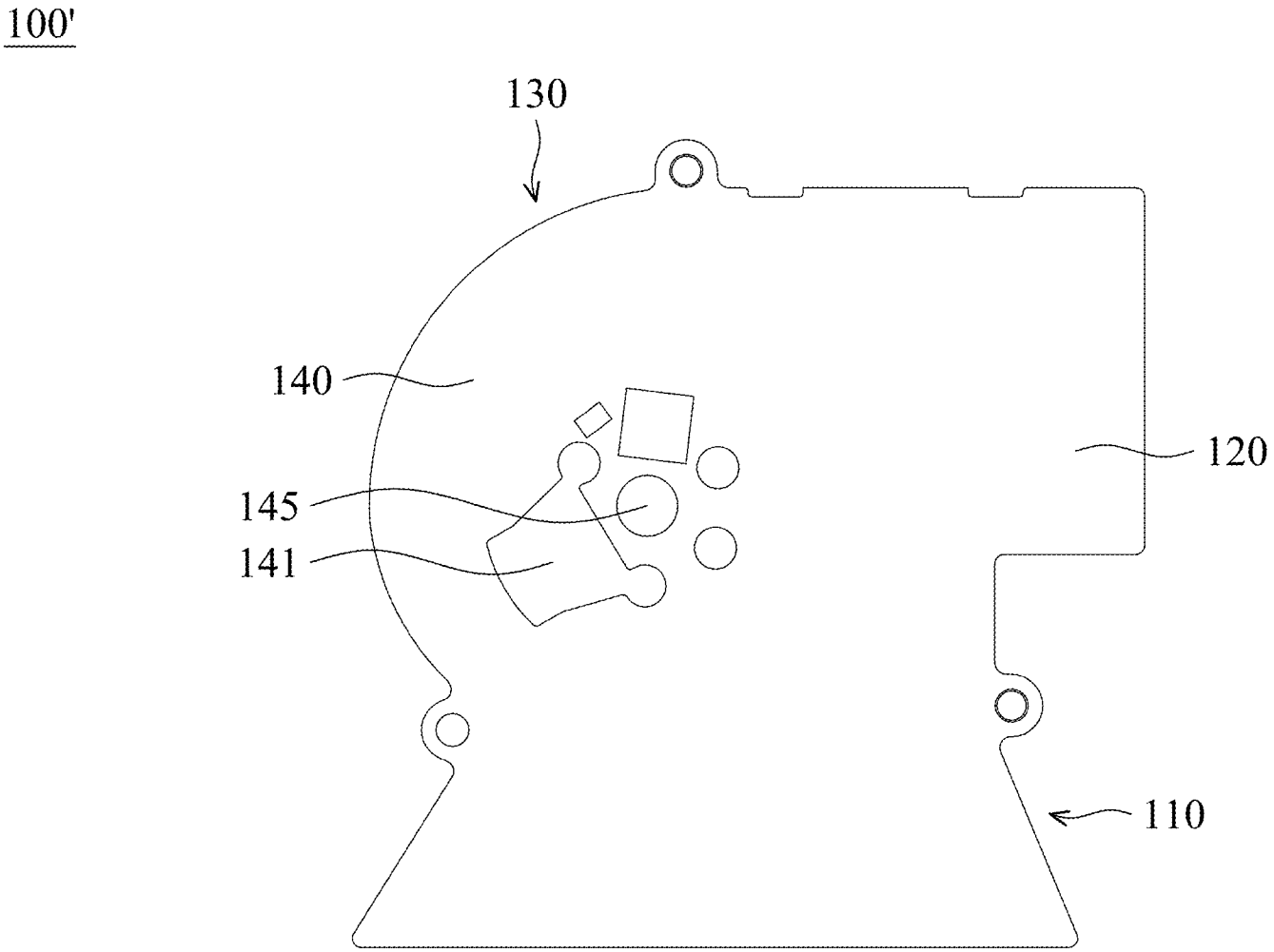
FIG. 4 shows a front view of the cooling component of the fan housing structure, in accordance with the second embodiment of the present disclosure.
Figure 5:
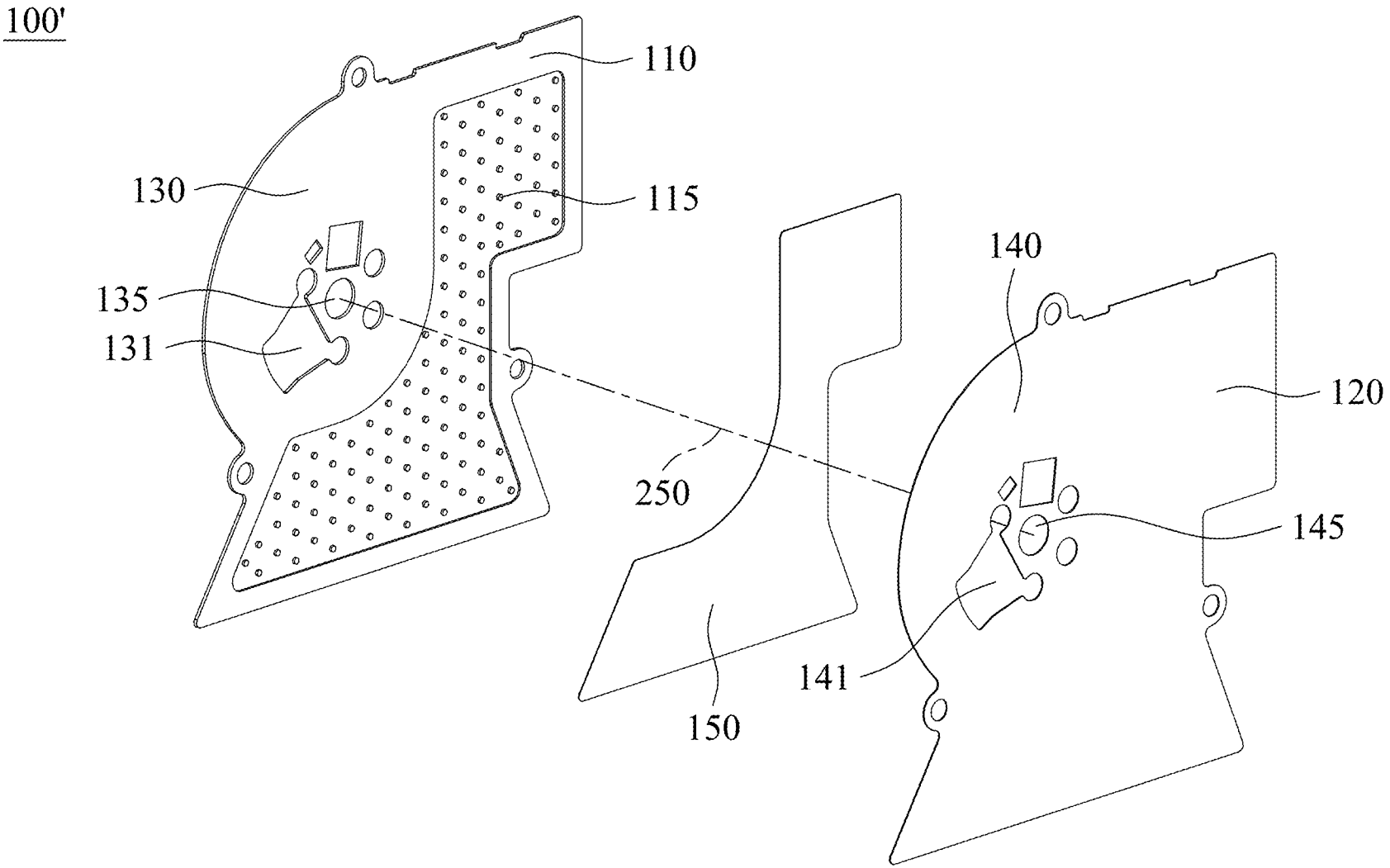
FIG. 5 shows a perspective exploded view of the cooling component of the fan housing structure, in accordance with the second embodiment of the present disclosure.

Next, the second embodiment of the present disclosure is described with respect to FIGS. 4 and 5. FIG. 4 shows a front view of the cooling component 100' of the fan housing structure 10, in accordance with the second embodiment of the present disclosure. FIG. 5 shows a perspective exploded view of the cooling component 100' of the fan housing structure 10, in accordance with the second embodiment of the present disclosure.

In various embodiments of the present description, the same component symbols are used to denote the same or similar components. For example, in the cooling component 100' of the second embodiment, the first sidewall 110, the second sidewall 120, the first extension portion 130, and the first chamber 150 are the same as the first sidewall 110, the second sidewall 120, the first extension portion 130, and the first chamber 150 of the cooling component 100 of the first embodiment. They are not repeated herein.

The difference between the cooling component 100' of the second embodiment and the cooling component 100 of the first embodiment is that the cooling component 100' further includes a second extension portion 140. The second extension portion 140 and the second sidewall 120 are formed integrally. The second extension portion 140 extends from the second sidewall 120 and corresponds to the first extension portion 130.

In the second embodiment, the second extension portion 140 is disposed opposite from the first extension portion 130 and is connected to the first extension portion 130. The first extension portion 130 and the second extension portion 140 may have substantially the same shape. Thus, in the front view shown in FIG. 4, the first extension portion 130 is right behind the second extension portion 140 and therefore cannot be seen. In addition, in the second embodiment, the entire first extension portion 130 and the entire second extension portion 140 may be connected by welding. That is, the first extension portion 130 and the second extension portion 140 are bonded in a way that both surfaces are entirely connected.

As shown in FIGS. 4 and 5, the second extension portion 140 has a second central part 141. The second central part 141 has one other connecting point 145. The other connecting point 145 of the second extension portion 140 corresponds to the connecting point 135 of the first extension portion 130. The fan 200 is connected to the connecting point 135 and the other connecting point 145 at the same time. In other words, the connecting point 135 and the other connecting point 145 act as the rivet points for the fan 200 at the same time. The rotational axis 250 of the fan 200 passes through the connecting point 135 and the other connecting point 145, as shown in FIG. 5.

In the present embodiment, the area of the second central part 141 and the area of the first central part 131 are equal. As mentioned above, the diameter of the first central part 131 or the second central part 141 are not limited. Users may change either diameter according to actual needs. Additionally, corresponding to the first central part 131, in the second central part 141, there may be other openings of different shapes around the other connecting point 145 that may be used to further secure the fan 200 or other components.

In the present embodiment, the first central part 131 and the second central part 141 are connected by welding. In cases where the first central part 131 and the second central part 141 have to be punched to form a connecting point 135, other connecting point 145 and/or other openings, the punching can be carried out in two different ways. In the first way, the first central part 131 and the second central part 141 are welded together and then punched together. The second way is to punch the first central part 131 and the second central part 141 separately, and then weld them together along the contour of the holes. The user can decide which punching method to use depending on the process requirements or welding area.

Figure 6:
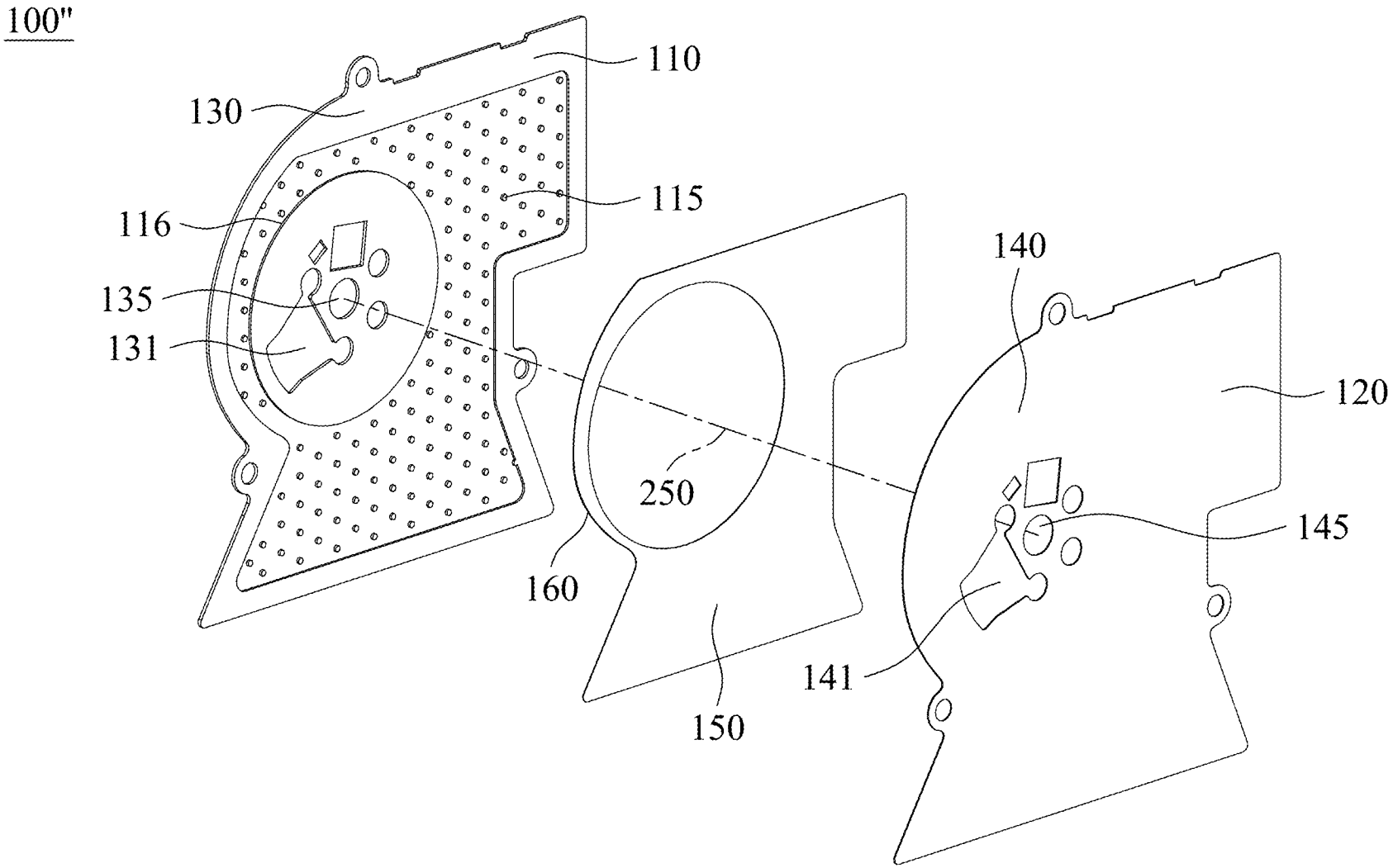
FIG. 6 shows a perspective exploded view of the cooling component of the fan housing structure, in accordance with the third embodiment of the present disclosure.

Next, the third embodiment of the present disclosure is described with respect to FIG. 6. FIG. 6 shows a perspective exploded view of the cooling component 100" of the fan housing structure 10, in accordance with the third embodiment of the present disclosure.

One of the differences between the cooling component 100" of the third embodiment and the cooling component 100' of the second embodiment is that the cooling component 100" further includes a second chamber 160.

In the third embodiment, the first extension portion 130 and the second extension portion 140 are not connected by the entire surface. In addition, what is different from both the first and second embodiments is that the edge of the first sidewall 110 and the edge of the second sidewall 120 are not entirely affixed together.

As shown in FIG. 6, a concaved portion 116 that is connected to the concaved portion 115 is formed on the first extension portion 130. The second chamber 160 is disposed in the concaved portion 116, so that the second chamber 160 is formed between the first extension portion 130 and the second extension portion 140, and the second chamber 160 is in fluid communication with the first chamber 150. Therefore, in the third embodiment, the first sidewall 110 and the first extension portion 130 are considered as the first plate, and the second sidewall 120 and the second extension portion 140 are considered as the second plate. The edges of the first plate and the second plate are then connected by welding and secured together.

In this case, the portions of the first plate and the second plate that are connected to each other include, in addition to the edges, the first central part 131 and the second central part 141 that are connected in the aforementioned manner. As shown in FIG. 6, the first central part 131 and the second central part 141 correspond to the circular area in the drawing that is surrounded by the concaved portion 116. In other words, in the third embodiment, the second chamber 160 surrounds the first central part 131 and the second central part 141. As such, the working fluid with heat dissipation function can surround the bearing of the fan 200 to further increase the area of the vapor chamber to enhance the heat dissipation efficiency.

Figure 7:
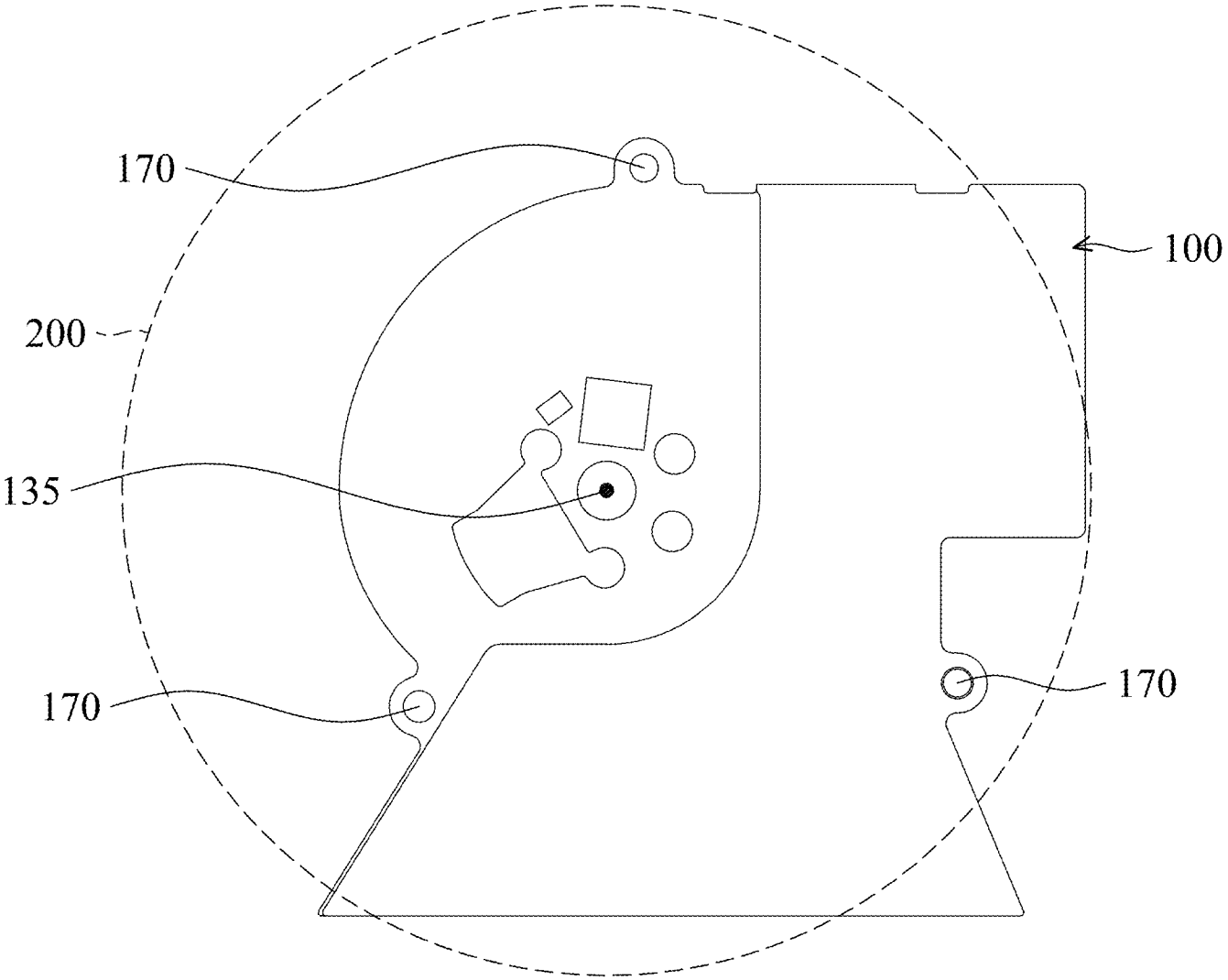
FIG. 7 shows a schematic front view of the combination of the fan and the cooling component, in accordance with some other embodiments of the present disclosure.

Next, some other embodiments of the present disclosure are described with respect to FIG. 7. FIG. 7 shows a schematic front view of the combination of the fan 200 and the cooling component 100, in accordance with some other embodiments of the present disclosure. In the embodiment shown in FIG. 7, the area covered by the fan 200 is larger than the area of the entire cooling component 100 when viewed along the rotational axis 250 of the fan 200 (e.g. the rotational axis 250 in FIG. 6 that passes through the connecting point 135). In FIG. 7, the area indicated by dotted lines represents the area covered by the blades of the fan 200. By increasing the diameter of the fan 200, the cooling efficiency can be further improved. However, the covered area of the fan 200 is not limited to the embodiment shown in FIG. 7. It may be larger or smaller depending on actual needs and structural design.

In addition, as shown in FIG. 7, a plurality of bonding portions 170 may be disposed around the cooling component 100 for further secure the fan 200 or the casing 300 (see FIG. 1). It may also be used for assembling the cooling component 100 to other components.

In FIGS. 1 and 7, only embodiments in which the fan 200 and/or the casing 300 is connected with the cooling component 100 are shown. However, the connecting method also applies to the aforementioned cooling component 100' or cooling component 100".

In summary, embodiments according to the present disclosure utilize a vapor chamber (cooling component 100, cooling component 100', or cooling component 100") as the support member for the bearing of the fan 200, so that the chamber structure of the vapor chamber (the first chamber 150 and/or the second chamber 160) is directly beneath the blades of the fan 200. This design helps to improve the heat conductivity of the fan housing structure 10, which in turn improves the overall heat dissipation efficiency of the fan 200.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan housing structure, comprising:

a cooling component, having:

a first sidewall;

a second sidewall, disposed opposite from the first sidewall, and connected to the first sidewall;

a first chamber formed between the first sidewall and the second sidewall; and a first extension portion that is formed integrally with the first sidewall, and extends from the first sidewall and protrudes from the second sidewall;

wherein the first extension portion has a first central part, and the first central part has a connecting point for connecting a fan, and wherein the fan is physically connected to the cooling component at the connecting point, and a rotational axis of the fan passes through the connecting point.

2. The fan housing structure as claimed in claim 1, wherein an edge of the first sidewall and an edge of the second sidewall are connected by welding.

3. The fan housing structure as claimed in claim 1, wherein the cooling component further comprises a second extension portion that extends from the second sidewall and corresponds to the first extension portion.

4. The fan housing structure as claimed in claim 3, wherein the second extension portion has one other connecting point that corresponds to the connecting point of the first extension portion, and the fan is connected to the connecting point and the other connecting point at the same time.

5. The fan housing structure as claimed in claim 4, wherein the entire first extension portion and the entire second extension portion are connected by welding.

6. The fan housing structure as claimed in claim 4, wherein the cooling component further comprises a second chamber that is formed between the first extension portion and the second extension portion.

7. The fan housing structure as claimed in claim 6, wherein the second chamber is in fluid communication with the first chamber.

8. The fan housing structure as claimed in claim 7, wherein the second extension portion has a second central part, and the other connecting point is located at the second central part.

9. The fan housing structure as claimed in claim 8, wherein the first central part and the second central part are connected by welding.

10. The fan housing structure as claimed in claim 9, wherein the second chamber surrounds the first central part and the second central part.

11. The fan housing structure as claimed in claim 1, wherein the area covered by the fan is larger than the area of the entire cooling component when viewed along the rotational axis of the fan.

12. The fan housing structure as claimed in claim 1, further comprising:

a casing that is connected to the cooling component and covers the fan.

* * * * *